US005204719A

United States Patent [19]

Bares

[11] Patent Number: 5,204,719

[45] Date of Patent: Apr. 20, 1993

[54] DEVELOPMENT SYSTEM

[75] Inventor: Jan Bares, Webster, N.Y.

[73] Assignee: Xerox Corporation, Stamford, Conn.

[21] Appl. No.: 832,876

[22] Filed: Feb. 10, 1992

[51] Int. Cl.[5] ..... G03G 15/08; G03G 15/06

[52] U.S. Cl. ..... 355/247; 118/647; 118/649; 355/261; 355/263; 355/265

[58] Field of Search ..... 355/247, 259, 261, 265, 355/262, 245, 263; 118/647, 648, 651, 649; 430/103

[56] References Cited

U.S. PATENT DOCUMENTS

| | | | |
|---|---|---|---|
| 4,868,600 | 9/1989 | Hays et al. | 355/259 |
| 5,031,570 | 7/1991 | Hays et al. | 355/261 X |
| 5,034,775 | 7/1991 | Folkins | 355/259 |

FOREIGN PATENT DOCUMENTS

| | | | |
|---|---|---|---|
| 0154770 | 11/1981 | Japan | 355/265 |

*Primary Examiner*—A. T. Grimley

*Assistant Examiner*—Matthew S. Smith

*Attorney, Agent, or Firm*—H. Fleischer; J. E. Beck; R. Zibelli

[57] ABSTRACT

An apparatus in which an electrostatic latent image recorded on a photoconductive member is developed with toner. A donor roll, spaced from the photoconductive member, transports toner to a development zone adjacent the photoconductive member, an electrode member is positioned in the development zone between the photoconductive member and the donor roll. The electrode member is electrically biased to detach toner from the donor roll so as to form a toner powder cloud in the space between the electrode member and the photoconductive member. In this way, the toner from the donor powder cloud develops the latent image recorded on the photoconductive member. A DC current is transmitted through the electrode member. A magnetic member interacts with the DC current flowing through the electrode member to substantially dampen vibrations of the electrode member.

16 Claims, 5 Drawing Sheets

DEVELOPMENT SYSTEM

This invention relates generally to the development of electrostatic latent images, and more particularly concerns a scavengeless development system in which a constant electrical bias applied on electrode wires interacts with a magnetic field to dampen vibration of the electrode wires.

This invention can be used in the art of electrophotographic printing. Generally, the process of electrophotographic printing includes charging a photoconductive member to a substantially uniform potential so as to sensitize the surface thereof. The charged portion of the photoconductive surface is exposed to a light image of an original document being reproduced. This records an electrostatic latent image on the photoconductive surface. After the electrostatic latent image is recorded on the photoconductive surface, the latent image is developed by bringing a developer material into contact therewith. Two component and single component developer materials are commonly used. A typical two-component developer material comprises magnetic granules having toner particles adhering triboelectrically thereto. A single component developer material typically comprises toner particles. Toner particles are attracted to the latent image forming a toner powder image on the photoconductive surface. The toner powder image is subsequently transferred to a copy sheet. Finally, the toner powder image is heated to permanently fuse it to the copy sheet in image configuration.

Single component development systems use a donor roll for transporting charged toner to the development nip defined by the donor roll and photoconductive surface. The toner is developed on the latent image recorded on the photoconductive member by a combination of mechanical and/or electrical forces. Scavengeless development and jumping development are two types of single component developments. A scavengeless development system uses a donor roll with a plurality of electrode wires closely spaced therefrom in the development zone. An AC voltage is applied to the wires forming a toner cloud in the development zone. The electrostatic field generated by the latent image attracts toner from the toner cloud to develop the latent image. In jumping development, an AC voltage is applied to the donor roller detaching toner from the donor roll and projecting the toner toward the photoconductive member so that the electrostatic fields generated by the latent image attract the toner to develop the latent image. Single component development systems appear to offer advantages of low cost and design simplicity. Two component development systems have been used extensively in many different types of printing machines. A two-component development system usually employs a magnetic brush developer roller for transporting carrier having toner adhering triboelectrically thereto. The electrostatic fields generated by the latent image attract the toner from the carrier so as to develop the latent image. In high speed commercial printing machines, a two-component development system may have lower operating costs than a single component development system. Clearly, two-component development systems and single component development systems each have their own advantages. It has been found that it is desirable to combine these systems to form a hybrid-type of development system incorporating the desirable features of each system. For example, at the Second International Congress on Advances in Non-Impact Printing held in Washington, DC, on Nov. 4, 1984 sponsored by the Society for Photographic Scientists and Engineers, Toshiba described a development system using a donor roll and a magnetic roller. The donor roll and magnetic roller were electrically biased. The magnetic roller transported two-component developer material to a nip defined by the donor roll and magnetic roll. Toner is attracted to the donor roll from the magnetic roll. The donor roll is rotated synchronously with the photoconductive drum. The large difference in potential between the donor roll and latent image recorded on the photoconductive drum causes the toner to jump across the gap from the donor roll to the latent image so as to develop the latent image. Other types of hybrid development systems have also employed electrode wires adjacent the donor in combination with a magnetic roller for transporting developer material. In this type of system, the magnetic roller advances developer material to a position adjacent the donor roller. The donor roller attracts the toner particles from the carrier granules of the developer material. Subsequently, as the donor roller rotates, toner is detached therefrom by the electrical field generated by the electrode wires. The detached toner forms a toner powder cloud in the development zone which develops the latent image recorded on the photoconductive surface. This type of development system is a hybrid scavengeless development system.

A problem with scavengeless development systems is that the electrode wire may move. This is referred to as strobing. Wire strobing occurs when the interaction between the electrode wires, the AC voltage applied thereon, the donor roll and toner materials create a condition wherein the wires physically oscillate causing a quality defect in the developed image.

The following disclosures may be relevant to various aspects of the present invention.

U.S. Pat. No. 4,868,600; Patentee: Hays et al.; Issued: Sep. 19, 1989.

Co-pending U.S. patent application Ser. No. 07/563,026; Applicant: Floyd, Jr. et al.; Filed: Aug. 3, 1990

The relevant portions of the foregoing disclosures may be briefly summarized as follows:

U.S. Pat. No. 4,868,600 describes a scavengeless development system in which toner is detached from a donor roll and powder cloud formed by AC electrically biased electrode wires. The donor roll is electrically biased by a DC voltage.

Co-pending U.S. patent application Ser. No. 07/563,026 describes a magnetic roll for transporting developer material from a reservoir to a donor roll and electrode wires that are electrically biased to detach toner from the donor rolls so as to form a toner cloud in the development zone.

In accordance with one aspect of the present invention, there is provided an apparatus for developing a latent image recorded on a surface with toner. The apparatus includes means, spaced from the surfaces for transporting toner to a development zone adjacent the surface. An electrode member is positioned in the development zone between the surface and the transporting means. Means are provided for electrically biasing the electrode member with at least a substantially constant current to detach toner from the transporting means. This forms a cloud of toner in the space between the electrode member and the surface with the toner developing the latent image. Magnetic means, interacting with the electrical biasing means, substantially dampen vibrations of the electrode member.

Pursant to another aspect of the present invention, there is provided an electrophotographic printing machine in which an electrostatic latent image recorded on a photoconductive member is developed with toner to form a visible image thereof. The printing machine includes means, spaced from the photoconductive member, for transporting toner to a development zone adjacent the photoconductive member. An electrode member is positioned in the development zone between the photoconductive member and the transporting means. Means are provided for electrically biasing the electrode member with at least a substantially constant current to detach toner from the transporting means so as to form a cloud of toner in the space between the electrode member and the photoconductive member with the toner developing the latent image. Magnetic means, interacting with the electrical means, substantially dampen vibrations of the electrode member.

Other features of the present invention will become apparent as the following description proceeds and upon reference to the drawings, in which.

While the present invention will be described in connection with preferred embodiments thereof, it will be understood that it is not intended to limit the invention to these embodiments. On the contrary, it is intended to cover all alternatives, modifications, and equivalents as may be included within the spirit and scope of the invention as defined by the appended claims. Inasmuch as the art of electrophotographic printing is well known, the various processing stations employed in the FIG. 1 printing machine will be shown hereinafter schematically and their operation described briefly with reference thereto.

Figure 1:
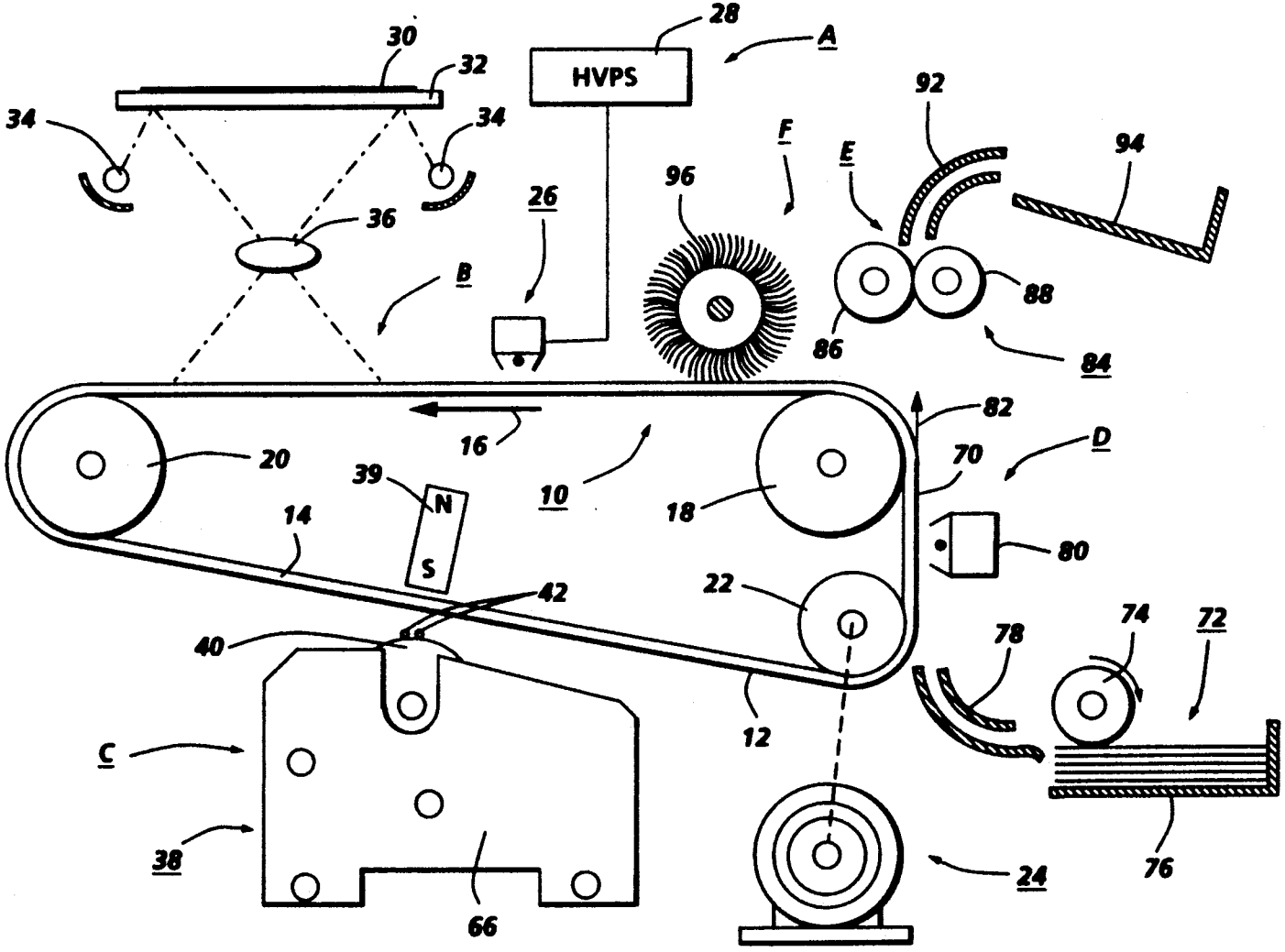
FIG. 1, is a schematic elevational view of an illustrative electrophotographic printing machine incorporating a development apparatus having the features of the present invention therein.

Referring initially to FIG. 1, there is shown an illustrative electrophotographic printing machine incorporating the development apparatus of the present invention therein. The electrophotographic printing machine employs a belt 10 having a photoconductive surface 12 deposited on a conductive substrate 14. Preferably, photoconductive surface 12 is made from a selenium alloy. Conductive substrate 14 is made preferably from an aluminum alloy that is electrically grounded. One skilled in the art will appreciate that any suitable photoconductive belt may be used. Belt 10 moves in the direction of arrow 16 to advance successive portions of photoconductive surface 12 sequentially through the various processing stations disposed throughout the path of movement thereof. Belt 10 is entrained about stripping roller 18, tensioning roller 20 and drive roller 22. Drive roller 22 is mounted rotatably in engagement with belt 10. Motor 24 rotates roller 22 to advance belt 10 in the direction of arrow 16. Belt 10 is maintained in tension by a pair of springs (not shown) resiliently urging tensioning roller 20 against belt 10 with the developed spring force. Stripping roller 18 and tensioning roller 20 are mounted to rotate freely.

Initially, a portion of belt 10 passes through charging station A. At charging station A, a corona generating device, indicated generally by the reference numeral 26, charges photoconductive surface 12 to a relatively high, substantially uniform potential. High voltage power supply 28 is coupled to corona generating device 26 to charge photoconductive surface of belt 10. After photoconductive surface 12 of belt 10 is charged, the charged portion thereof is advanced through exposure station B.

At exposure station B, an original document 30 is placed face down upon a transparent platen 32. Lamps 34 flash light rays onto original document 30. The light rays reflected from original document 30 are transmitted through lens 36 to form a light image thereof. Lens 36 focuses this light image onto the charged portion of photoconductive surface 12 to selectively dissipate the charge thereon. This records an electrostatic latent image on photoconductive surface 12 that corresponds to the informational areas contained within original document 30.

After the electrostatic latent image has been recorded on photoconductive surface 12, belt 10 advances the latent image to development station C. At development station C, a developer unit, indicated generally by the reference numeral 38, developes the latent image recorded on the photoconductive surface. Preferably, developer unit 38 includes donor roll 40 and electrode wires 42. Electrode wires 42 are electrically biased relative to donor roll 40 to detach toner therefrom so as to form a toner powder cloud in the gap between the donor roll and the photoconductive surface. The latent image attracts toner particles from the toner powder cloud forming a toner powder image thereon. Donor roll 40 is mounted, at least partially, in the chamber of developer housing 66. The chamber of developer housing 66 stores a supply of developer material. In one embodiment, the developer material is a single component developer material of toner particles, whereas in another embodiment, the developer material includes at least carrier granules and toner particles. In addition, there is shown a magnetic member 39 positioned adjacent belt 10 on the side thereof opposed from electrode wires 42. In addition to an alternating voltage, electrode wires 42 are electrically biased with a constant voltage to cause a constant current flow through the wires. The constant current interacts with the magnetic field generated by magnetic member 39 to dampen vibrations of electrode wires 42. Various embodiments of the development system will be discussed hereinafter, in greater detail, with reference to FIGS. 2-5, inclusive.

With continued reference to FIG. 1, after the electrostatic latent image is developed, belt 10 advances the toner powder image to transfer station D. A copy sheet 70 is advanced to transfer station D by sheet feeding apparatus 72. Preferably, sheet feeding apparatus 72 includes a feed roll 74 contacting the uppermost sheet of stack 76. Sheet feeding apparatus 72 advances sheet 70 into chute 78. Chute 78 directs the advancing sheet of support material into contact with photoconductive surface 12 of belt 10 in a timed sequence so that the toner powder image developed thereon contacts the advancing sheet at transfer station D. Transfer station D includes a corona generating device 80 which sprays ions onto the back side of sheet 70. This attracts the toner powder image from photoconductive surface 12 to sheet 70. After transfer, sheet 70 continues to move in the direction of arrow 82 onto a conveyor (not shown) that advances sheet 70 to fusing station E.

Fusing station E includes a fuser assembly indicated generally by the reference numeral 84, which permanently affixes the transfered powder image to sheet 70. Fuser assembly 84 includes a heated fuser roller 86 and back-up roller 88. Sheet 70 passes between fuser roller 86 and back-up roller 88 with the toner powder image contacting fuser roller 86. In this manner, the toner powder image is permanently affixed to sheet 70. After fusing, sheet 70 advances chute 92 to catch tray 94 for subsequent removal from the printing by the operator.

After the sheet is separated from photoconductive surface 12 of belt 10, the residual toner particles adhering to photoconductive surface 12 are removed therefrom at cleaning station F. Cleaning station F includes a rotatably mounted fibrous brush 96 in contact with photoconductive surface 12. The particles are cleaned from photoconductive surface 12 by the rotation of brush 96 in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the development apparatus of the present invention therein.

Figure 2:
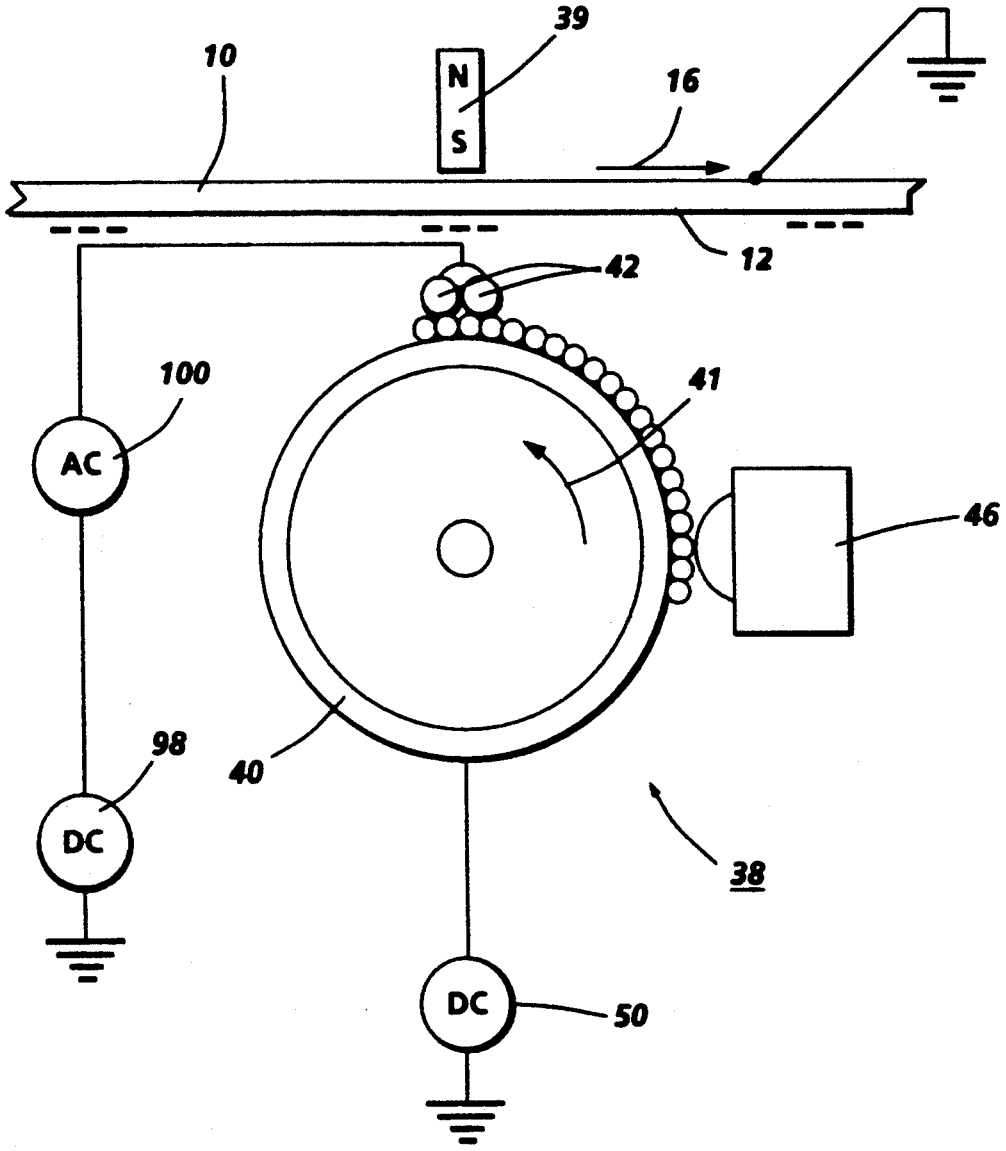
FIG. 2, is a schematic elevational view showing one embodiment of the development apparatus used in the FIG. 1 print machine.

Referring now to FIG. 2, there is shown one embodiment of the present invention in greater deal. The development system 38 includes a donor roll 40, electrode wires 42, and metering and charging roll 46. The donor roll attracts toner from the reservoir and roll 46 charges the toner on the donor roll. The donor roll 40 can be rotated either the "with" or "against" direction relative to the direction of motion of belt 10. The donor roll is shown rotating in the direction of arrow 41. The metering and charging roll 46 may comprise any suitable device for metering and charging the donor. For example, they comprise an apparatus such as described in U.S. Pat. No. 4,459,009 wherein the contact between weekly charged toner particles and a triboelectrically actively coated charging roll results in well charged toner. Other combination metering and charging devices may also be employed.

The developer apparatus 38 further has electrode wires 42 located in the space between photoconductive surface 12 and donor roll 40 as described in U.S. Pat. No. 4,868,600. The electrode wires 42 include one or more thin tungsten wires which are likely positioned against the donor roll. The distance between the wires 42 and the donor roll 40 is approximately the thickness of the toner layer on the donor roll 40. The extremities of the wires are supported by the tops of bearing blocks (not shown) which also support the donor roll 40 for rotation. A DC electrical bias is applied to the electrical wires by voltage source 98 to cause a DC current to flow through the wires. An AC electrical bias is also applied to the electrical wires by voltage source 100. A bar magnet 39 is positioned behind belt 10 on the side thereof opposed from electrode wires 42. Bar magnetic 39 develops a magnetic field perpendicular to the electrode wires and the movement thereof. The magnetic field interacts with the current flowing through wires 42 to dampen the vibration. Additionally, the DC current flowing through the electrode wires 42 induces eddy currents in donor roll 40. It has been found that the combination of eddy currents developed by the DC current flowing through the electrode wires and the magnetic field perpendicular to the direction of motion of the electrode wires tends to substantially dampen vibration of the electrode wires. Thus, wire strobing is substantially canceled.

In another embodiment, no DC current is supplied to wires 42. The DC current source 98 is removed and the ends of wires 42 are electrically grounded. Since the wires are electrically grounded, wire vibration in magnetic field induces a current flowing through the ground loop. This generates forces which suppress vibration of wires 42.

A DC power supply 50 establishes an electrostatic field between photoconductive surface 12 and donor roll 40 for attracting the detached toner particles from the clouds surrounding wires 42 to the latent image recorded on photoconductive surface 12.

Figure 3:
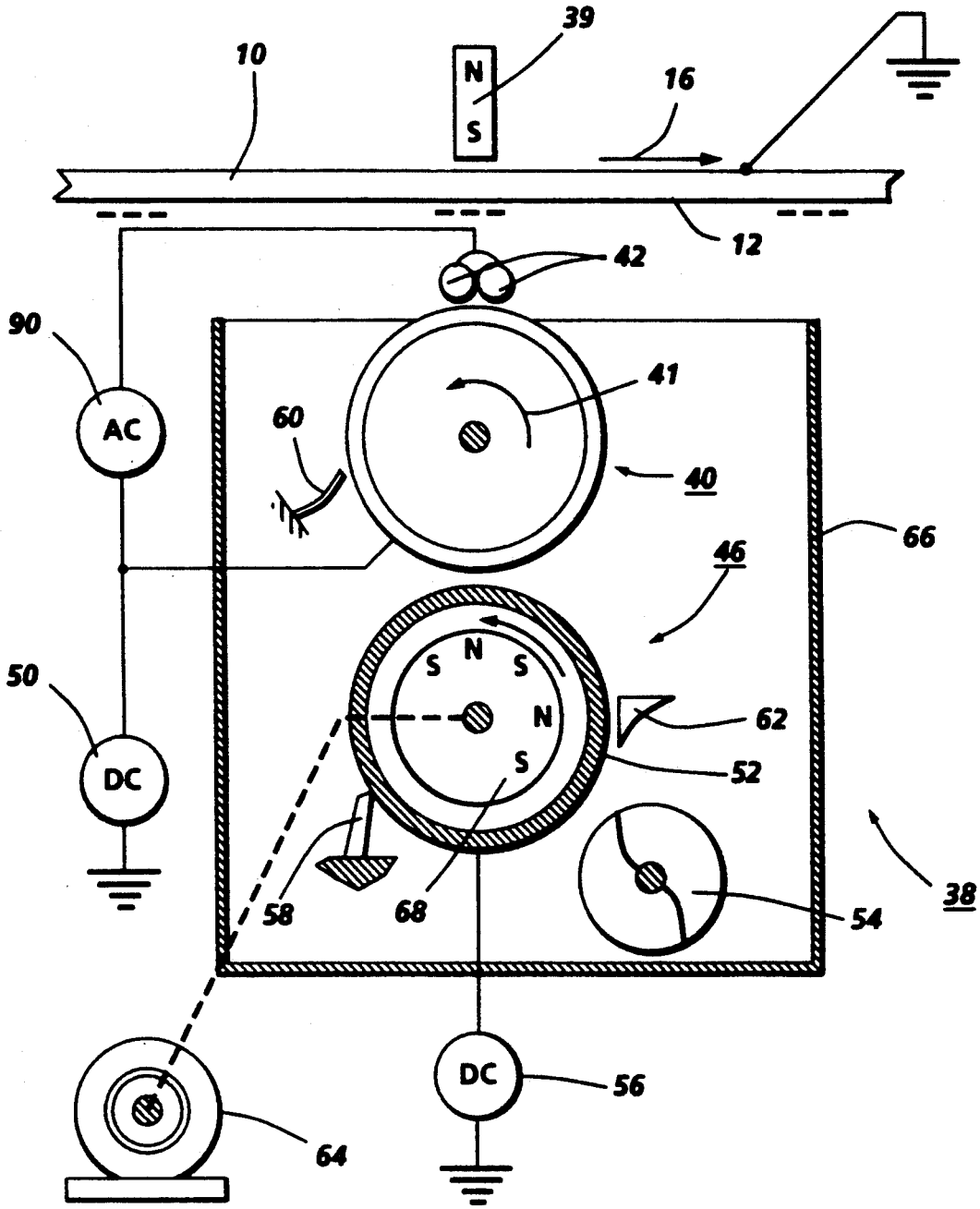
FIG. 3, is a schematic elevational view showing another embodiment of the development apparatus used in the FIG. 1 printing machine.

Referring now to FIG. 3, there is shown another embodiment of the present invention in greater detail. The development system 38 includes a donor roll 40, electrode wires 42 and magnetic roll 46. Donor roll 44 conveys developer material comprising toner deposited thereon by magnetic roll 46. The donor roll can be rotated in either the "with" or "against" direction relative to the direction of motion of belt 10. The donor roll is shown rotating in the direction of arrow 41.

Developer apparatus 38 has electrode wires 42 located in the space between photoconductive surface 12 and donor roll 40. The electrode wires include one or more thin tungsten wires which are lightly positioned against the donor roll 40. The distance between the wires and the donor roll is approximately the thickness of the toner layer on the donor roll. The extremities of the wire are supported by the tops of end bearing blocks (not shown) which also support the donor roll 40 for rotation.

An AC electrical bias is applied to the electrode wires by AC voltage source 90. In addition, a DC power supply 50 electrically biases electrode wires 42 and donor roll 40. Magnetic bar 39 is disposed adjacent belt 10 on the side thereof opposed from electrode wires 42. Electrode wires 42 are located in the space between belt 10 and donor roll 40. This space defines the development zone. Once again, the current in electrode wires 42 as well as the magnetic field generated by magnetic bar 39 perpendicular to the direction of electrode wires 42 substantially dampen vibration of electrode wires 42.

DC power supply 50 establishes an electrostatic field between photoconductive surface 12 and donor roll 40 for attracting the detached toner particles from the cloud surrounding the wires 42 to the latent image recorded on photoconductive surface. Magnetic roll 46 advances developer material comprising at least carrier granules and toner particles to location adjacent donor roll 40. Magnetic roll 46 includes a non-magnetic tubular member or sleeve 52 made preferably from aluminum and having the exterior circumferential surface thereof roughened. An elongated multiple magnet 68 is positioned interiorly of and spaced from the tubular member. Tubular member 52 is mounted on suitable bearings and coupled to motor 64 for rotation thereby. Toner particles are attracted from the carrier granules on magnetic roll to the donor roll. Scraper blade 58 moves denuded carrier granules on extraneous developer material from the surface of tubular member 52. Metering blade 62 adjusts the quantity of developer material being advanced to the loading zone adjacent the donor roll.

As successive electrostatic latent images are developed, the toner particles within the developer material are depleted. Augers 54 are mounted rotatably to mix fresh toner particles with the remaining developer material so that the resultant developer material therein is substantially uniform with the concentration of toner particles being optimized.

Figure 4:
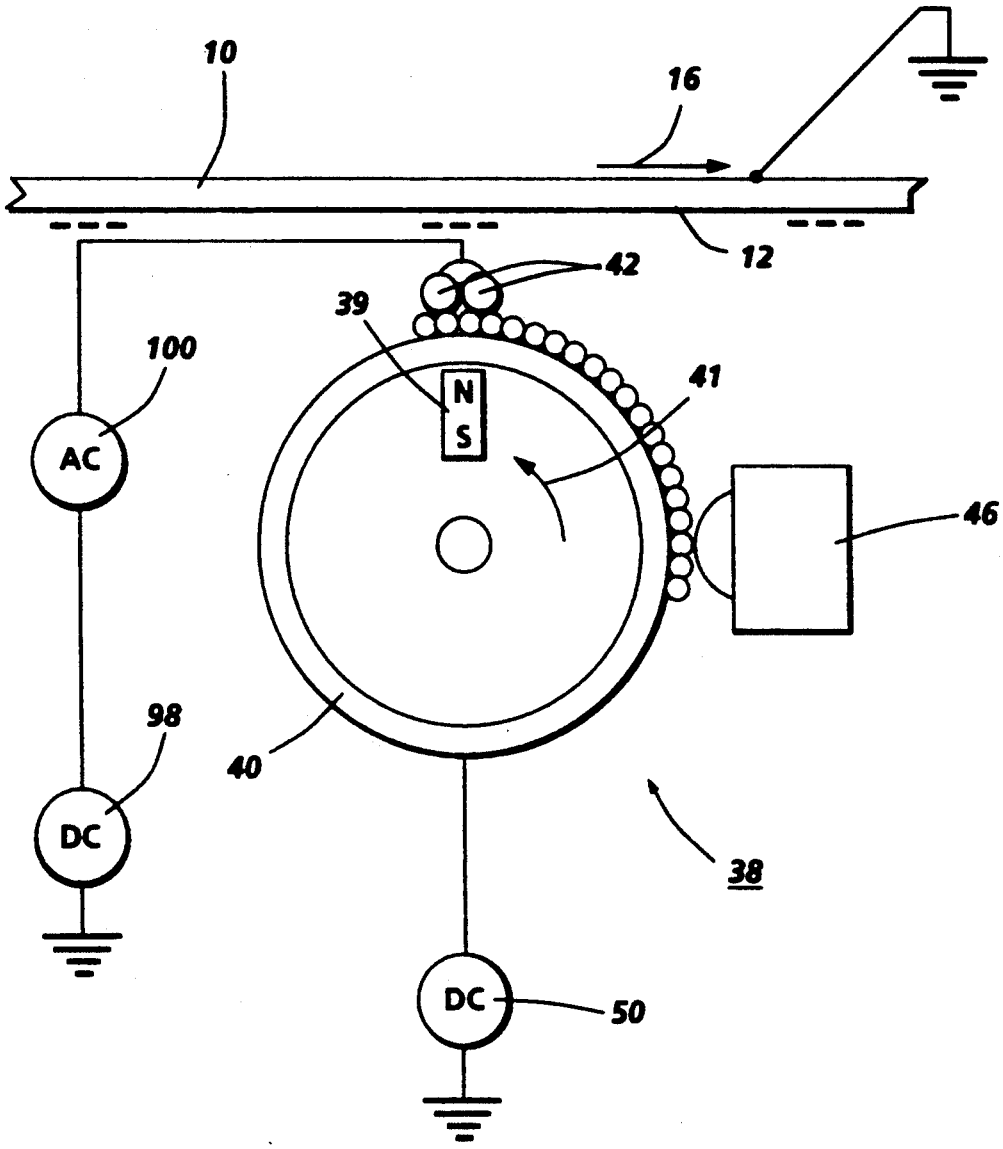
FIG. 4, is a schematic elevational view showing another embodiment of the development apparatus used in the FIG. 1 printing machine.

Referring now to FIG. 4, there is shown another embodiment of the development system used in the FIG. 1 printing machine. As depicted thereat, the embodiment shown in FIG. 4 is substantially identical to the embodiment depicted in FIG. 2. However, rather than having the magnetic bar located on the side of belt 10 opposed from electrode wires 42 as shown in FIG. 2, magnetic bar 39 is disposed interiorly of donor roll 40. Magnetic bar 39 is located inside donor 40 and is positioned stationarily in a location opposed from electrode wires 42. In this location, magnetic bar 39 develops a magnetic field substantially perpendicular to the direction of movement of electrode wires 42 so as to interact with the current flowing through electrode wires 42. The current flowing through the wires induces eddy currents in the donor roll. Both of the effects substantially dampen vibration of electrode wires 42.

Figure 5:
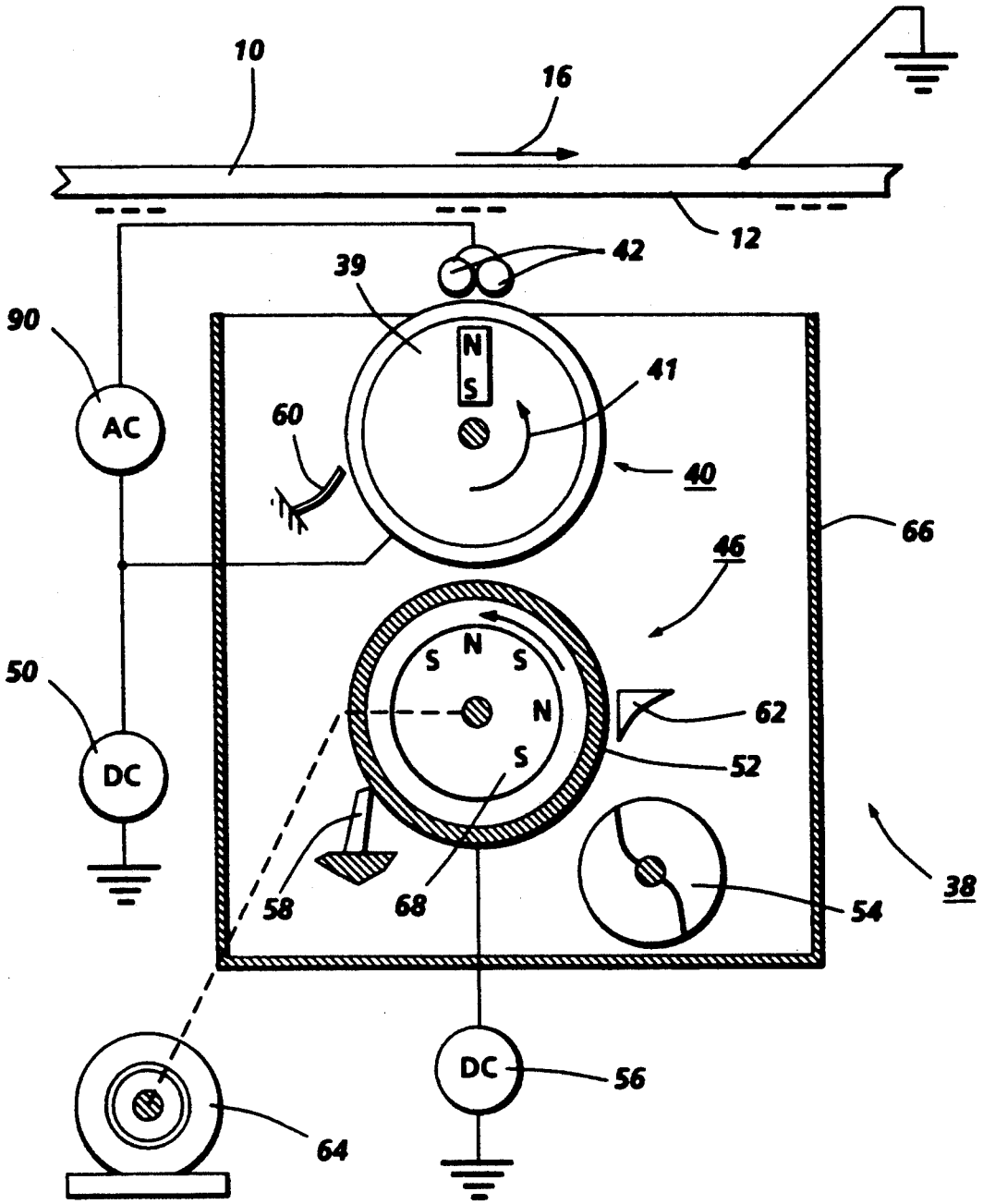
FIG. 5, is a schematic elevational view showing another embodiment of the development apparatus used in the FIG. 1 printing machine.

Turning now to FIG. 5, there is shown still another embodiment of the development apparatus used in FIG. 1. The development apparatus depicted in FIG. 5 is substantially identical to that of FIG. 3. However, magnetic bar 39 is located interiorly of donor roll 40 rather than being positioned on the opposed side of belt 10. Magnetic bar 39 is positioned stationarily inside donor roll 40 opposed from electrode wires 42. In this location, magnetic bar 39 develops a magnetic field substantially perpendicular to the direction of movement of electrode wires 42. The magnetic field generated by magnetic bar 39 in conjunction with the eddy currents being generated by the DC voltage applied to electrode wires 42 substantially dampen vibration of electrode wires 42.

In recapitulation, it is evident that the development system of the present invention includes electrode wires positioned closely adjacent to the exterior surface of a donor roll in the gap defining the development zone between the donor roll and the photoconductive belt. A magnetic field is generated substantially perpendicular to the direction of movement of the electrode wires. In addition, a DC voltage is applied to the electrode wires to generate current therein. The current in combination with the magnetic field and the eddy currents induced in the donor roll substantially dampen vibration of the electrode wires.

It is, therefore, apparent that there has been provided in accordance with the present invention, a development system that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. An apparatus for developing a latent image recorded on a surface with non-magnetic toner, including:

means, spaced from the surface, for transporting non-magnetic toner to a development zone adjacent the surface, said transporting means being substantially non-magnetic;

an electrode member positioned in the development zone between the surface and said transporting means;

means for electrically biasing said electrode member to detach toner from said transporting means so as to form a cloud of toner in the space between said electrode member and the surface with the toner developing the latent image, said electrode member having a substantially constant current flowing therethrough; and magnetic means for generating a magnetic field interacting with the constant current flowing through said electrode member to substantially dampen vibrations of said electrode member, said magnetic means being disposed on one side of the surface with said electrode member being located on the opposed side of the surface.

2. An apparatus according to claim 1, wherein said electrode member includes a plurality of wires.

3. An apparatus according to claim 2, wherein said transporting means includes a donor roll.

4. An apparatus according to claim 3, wherein said biasing means electrically biases said electrode wires relative to said donor roll with a DC electrical potential and AC electrical potential.

5. An apparatus for developing a latent image recorded on a surface with toner, including:

means, spaced from the surface, for transporting toner to a development zone adjacent the surface, said transporting means includes a donor roll;

an electrode member positioned in the development zone between the surface and said transporting means, said electrode member includes a plurality of wires;

means for electrically biasing said electrode member to detach toner from said transporting means so as to form a cloud of toner in the space between said electrode member and the surface with toner developing the latent image, said electrode member having a constant current flowing therethrough, said biasing means electrically biases said electrode wires relative to said donor roll with a DC electrical potential and AC electrical potential;

magnetic means for generating a magnetic field interacting with the constant current flowing through said electrode member to substantially dampen vibrations of said electrode member, said magnetic means includes a magnetic member disposed on one side of the surface with said electrode wires being located on the opposed side of the surface.

6. An apparatus according to claim 5, wherein said magnetic means includes a magnetic member disposed interiorly of said donor roll opposed from said electrode wires.

7. An apparatus according to claim 5, further including means for advancing developer material comprising at least carrier and toner to a position adjacent said donor roll with toner being attracted to said donor roll.

8. An apparatus according to claim 7, wherein said advancing means includes a magnetic roll.

9. An electrophotographic printing machine of the type in which an electrostatic latent image recorded on a photoconductive member is developed with non-magnetic toner to form a visible image thereof, wherein the improvement includes:

means, spaced from the photoconductive member, for transporting non-magnetic toner to a development zone adjacent the photoconductive member, said transporting means being substantially non-magnetic;

an electrode member positioned in the development zone between the photoconductive member and said transporting means;

means for electrically biasing said electrode member to detach toner from said transporting means so as to form a cloud of toner in the space between said electrode member and the photoconductive member with the toner developing the latent image recorded on the photoconductive member, said electrode member having a substantially constant current flowing therethrough; and magnetic means for generating a magnetic field interacting with the constant current flowing through said electrode member to substantially dampen vibrations of said electrode member, said magnetic means being disposed on one side of the photoconductive member with said electrode member being located on the opposed side of the photoconductive member.

10. A printing machine according to claim 9, wherein said electrode member includes a plurality of wires.

11. A printing machine according to claim 10, wherein said transporting means includes a donor roll.

12. A printing machine according to claim 11, wherein said electrical biasing means electrically biases said electrode wires relative to said donor roll with a DC potential and an AC potential.

13. An electrophotographic printing machine of the type in which an electrostatic latent image recorded on a photoconductive member is developed with toner to form a visible image thereof, wherein the improvement includes:

means, spaced from the photoconductive member, for transporting toner to a development zone adjacent the photoconductive member, said transporting means includes a donor roll;

an electrode member positioned in the development zone between the photoconductive member and said transporting means, said electrode member includes a plurality of wires;

means for electrically biasing said electrode member to detach toner from said transporting means so as to form a cloud of toner in the space between said electrode member and the photoconductive member with the toner developing the latent image recorded on the photoconductive member, said electrode member having a constant current flowing therethrough, said electrical biasing means electrically biases said electrode wires relative to said donor roll with a DC potential and an AC potential;

magnetic means for generating a magnetic field interacting with the constant current flowing through said electrode member to substantially dampen vibrations of said electrode member, said magnetic means includes a magnetic member disposed on one side of the photoconductive member with said electrode wires being located on the opposed side of the photoconductive member.

14. A printing machine according to claim 13, wherein said magnetic means includes a magnetic member disposed interiorly of said donor roll opposed from said electrode wires.

15. A printing machine according to claim 13, further including means for advancing developer material comprising at least carrier and toner to a position adjacent said donor roll with toner being attracted to said donor roll.

16. A printing machine according to claim 15, wherein said advancing means includes a magnetic roll.

* * * * *